US008230949B2

(12) United States Patent
Blevins et al.

(10) Patent No.: US 8,230,949 B2
(45) Date of Patent: Jul. 31, 2012

(54) AUGER BORING MACHINE HAVING SPOILS EJECTOR

(76) Inventors: William C. Blevins, Sandy Hook, KY (US); Brian J. Froehlich, Galena, OH (US)

( * ) Notice: Subject to any disclaimer, the term of this patent is extended or adjusted under 35 U.S.C. 154(b) by 294 days.

(21) Appl. No.: 12/660,122

(22) Filed: Feb. 22, 2010

(65) Prior Publication Data

US 2011/0203853 A1 Aug. 25, 2011

(51) Int. Cl.
*E21B 27/04* (2006.01)

(52) U.S. Cl. ..... 175/88; 175/171

(58) Field of Classification Search ..... 175/53, 175/88, 171, 323

See application file for complete search history.

(56) References Cited

U.S. PATENT DOCUMENTS 3,856,093 A * 12/1974 Case ..... 173/152
5,228,525 A * 7/1993 Denney et al. ..... 175/122

* cited by examiner

*Primary Examiner* — William P Neuder
(74) *Attorney, Agent, or Firm* — Jason H. Foster; Kremblas & Foster

(57) ABSTRACT

An auger boring machine having spoils ejector having a power source attached to an auger, a plurality of large casings extending linearly from the power source, a plurality of small casings located linearly within the large casings and centered within the large casings with the auger extending linearly within the small casings, a cutting head attached to the terminal end of the large casings, and a spoils ejector, with the spoils ejector attached to the auger and to the cutting head, with the spoils ejector located between the terminal end of the small casings and the cutting head, with the spoils ejector enclosed within the large casings, with the spoils ejector having a front, a back, first and second sides each attached to the front and to the back, first and second curved plates each attached the front, the back, and to the first and second sides, at least one of the sides having a collector aperture formed therein adjacent one of the curved plates, with the back having formed therein at least one spoils port.

15 Claims, 5 Drawing Sheets

AUGER BORING MACHINE HAVING SPOILS EJECTOR

BACKGROUND OF THE INVENTION

1. Field of the Invention

This invention relates generally to tunnel boring machines, and more particularly to a machine that utilizes a casing centered within a casing structure, and still more particularly to one which utilizes a spoils ejector adjacent the cutting head at the forward end of the auger that is turned by the boring machine.

2. Description of the Related Art

This invention is directed to the providing of an auger boring machine of the type used in the installation of in-ground pipe. For decades, prior art boring machines have been positioned on tracks in a large hole at the initiation site of a tunnel. The machine has a power source that pushes a casing into a tunnel dug by a rotating drill head. This digging is accomplished by the power source turning an auger that extends within and is parallel to the casing. At the terminal end of the auger is a drilling head that revolves as the auger spins, the drilling head cuts soil and/or rocks loose from the ground. The cut soil and/or rock are referred to as spoils and are evacuated from the tunnel by the auger blade.

Prior art tunnel boring machines bore tunnels 4-96" in diameter. The machines cost thousands of dollars to set up to begin the digging of a tunnel. When adjustments need to be made, it can take a day. Oftentimes, the auger used in these machines has to be removed from within the casing if a problem is encountered at the cutting head. This takes time and incurs expense.

It is thus apparent that the need exists for an improved tunnel boring machine which in addition to being easy to use, permits tunnels to be bored faster and more economically than in the past.

SUMMARY OF THE INVENTION

In accordance with the present invention, there is disclosed an auger boring machine having spoils ejector with the machine having a power source with the power source attached to an auger, a plurality of large casings extending linearly from the power source, a plurality of small casings located linearly and centered within the large casings, with the auger extending linearly within the small casings, a cutting head attached to the terminal end of the large casings, and a spoils port.

The spoils ejector is attached to the auger and to the cutting head, with the spoils ejector located between the terminal end of the small casings and the cutting head. The spoils ejector is enclosed within the large casings, with the spoils ejector having a front, a back, first and second sides each attached to the front and to the back, and first and second curved plates each attached to the front, the back, and to the first and second sides. At least one of the sides has a collector aperture formed therein adjacent one of the curved plates. The back has formed therein at least one spoils port.

The terminal end of the small casings has an end plate attached thereto. The terminal end of the small casings has a notch formed therein, with the notch having a pair of side surfaces and an arcuate (i.e. arc shaped) surface. Each of the side surfaces has one end connected to the arcuate surface and another end connected to the end plate. The end plate has an arcuate end plate recess formed therein.

The spoils ejector front has a front first plate and a front second plate. The spoils ejector back has a back first plate and a back second plate. The spoils ejector first side has a spoils ejector first side first plate and a spoils ejector first side second plate. The spoils ejector second side has a spoils ejector second side first plate and a spoils ejector second side second plate. The back first plate and the back second plate each have a spoils port formed therein, each spoils port forming an aperture in the back first plate and the back second plate respectively. Both the first side and the second side have a collector aperture formed therein.

The first curved plate and the second curved plate each have a beveled edge. Each beveled edge is located on a portion of the curved plate adjacent the collector aperture, with the portion of the curved plate extending outwardly beyond the spoils ejector side. The spoils ejector is attached to the auger by a male hex insert, with the male hex insert having a hex and a hex hub. The hex hub is retained in a sleeve, with the sleeve extending between the spoils ejector front and the spoils ejector back. The sleeve is retained between the spoils ejector front first plate and the spoils ejector front second plate, and between the spoils ejector back first plate and the spoils ejector back second plate.

There is also disclosed an auger boring machine having spoils ejector, with the machine having a power source attached to an auger, a plurality of large casings extending linearly from the power source, and with the plurality of large casings having a terminal end. A plurality of small casings is located linearly within the large casings, with the auger extending linearly within the small casings, and with the small casings having a terminal end. The terminal end of the small casings has an end plate attached thereto. The terminal end of the small casings has a notch formed therein, with the notch having a pair of side surfaces and an arcuate surface. Each of the side surfaces has one end connected to the arcuate surface and another end connected to the end plate. A cutting head is attached to the terminal end of the large casings.

The auger boring machine also has a spoils ejector, with the spoils ejector attached to the auger and to the cutting head. The spoils ejector is located between the terminal end of the small casings and the cutting head. The spoils ejector is enclosed within the large casings, with the spoils ejector having a front, a back, and first and second sides each attached to the spoils ejector front and to the spoils ejector back. There are first and second curved plates each attached to the front, the back, and to the first and second sides, with at least one of the sides having a collector aperture formed therein adjacent one of the curved plates, and with the spoils ejector back having formed therein at least one spoils port.

There is also disclosed an auger boring machine spoils ejector having a back and a front. The back is configured for attachment to an auger and the front is configured for attachment to a cutting head. The spoils ejector has a front, a back, and first and second sides each attached to the front and to the back, with first and second curved plates each attached to the front, the back, and to the first and second sides, with at least one of the sides having a collector aperture formed therein. Adjacent one of the curved plates, the back has formed therein at least one spoils port. Preferably the spoils ejector front has a front first plate and a front second plate. Preferably the spoils ejector back has a back first plate and a back second plate. Preferably the spoils ejector first side has a spoils ejector first side first plate and a spoils ejector first side second plate. Preferably the spoils ejector second side has a spoils ejector second side first plate and a spoils ejector second side second plate. Preferably the back first plate and the back second plate each have a spoils port formed therein. Each spoils port forms an aperture in the back first plate and the back second plate respectively. Preferably both the first side and the second side have a collector aperture formed therein. The spoils ejector has a male hex insert having a hex and a hex hub. The hex hub is retained in a sleeve that extends between the spoils ejector front and the spoils ejector back. The sleeve is retained between the spoils ejector front first plate and the spoils ejector front second plate, and between the spoils ejector back first plate and the spoils ejector back second plate.

The primary objective of this invention is to provide a tunnel boring machine that can bore longer tunnels faster and more economically than the machines of the prior art.

Another objective of this invention is to provide a spoils ejector for an auger boring machine that can evacuate spoils from a casing of a first diameter through a casing of a second diameter, with the first diameter being greater than the second diameter, and with the smaller diameter casing being centered within the larger diameter casing.

Other objects and advantages of the invention will be apparent from the following description, the accompanying drawings and the appended claims.

Figure 1:
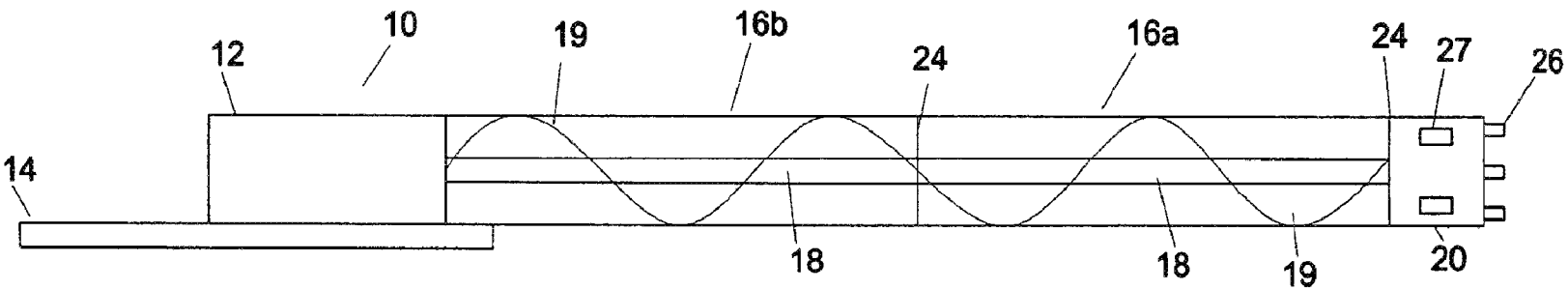
Fig. 1 (Prior Art)
FIG. 1 is a schematic view of a prior art auger boring machine.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION OF THE INVENTION

Having reference to the drawings, attention is directed first to FIG. 1 which discloses a schematic drawing of a prior art auger boring machine designated generally by the numeral 10. The basic components of such a machine include a power source such as an engine 12, with the power source 12 positioned on tracks 14 to facilitate the passage of casings into the tunnel dug by the cutting head. The plurality of casings 16 used in the boring of a tunnel includes a first casing 16*a* and second and subsequent casings 16*b*.

An auger 18 with its auger blade 19 has its one end attached to the power source and the other end attached to a cutting head 20. The auger in the prior art machines is approximately the same diameter as the interior diameter of the casings 16, which typically are relatively large. The adjacent casings are secured to each other typically by welding or other appropriate fastening means. The cutting head 20 uses cutters 26 to cut into the soil and cause rocks and soil to pass through openings called dirt ports 27 in the outer surface of the cutting head 20 and be deposited into the interior of the casing. The turning auger blade then causes the residue called spoils to be moved towards the power source where the residue can be evacuated from the interior of the casings which form the tunnel. Directional adjustment of the cutting head is facilitated through the use of stabilizers 27.

Figure 2:
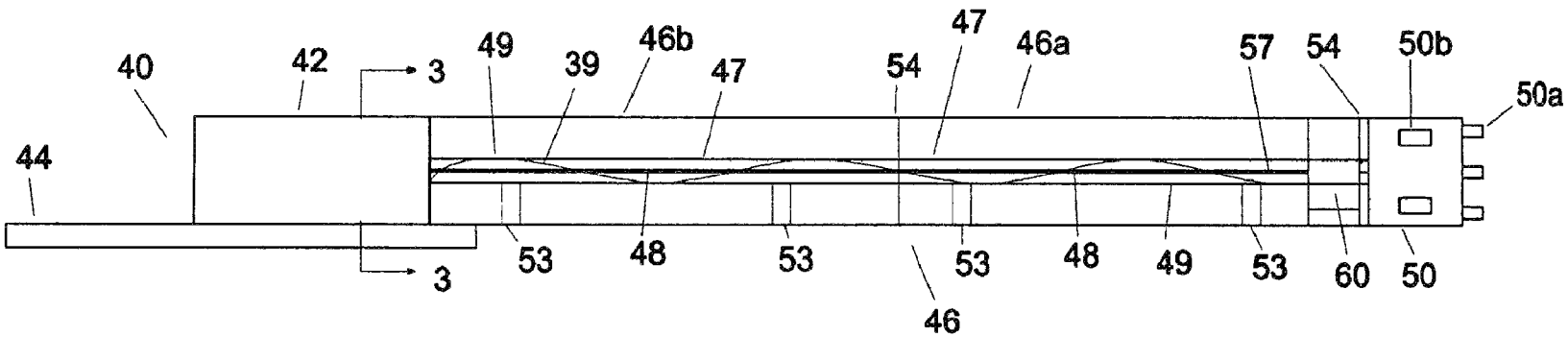
FIG. 2 is a schematic view of an auger boring machine made in accordance with this invention.

FIG. 2 discloses an auger boring machine with a spoils ejector made in accordance with the present invention. The term "spoils ejector" as used herein refers to an apparatus also referred to as a "dipper". The auger boring machine of this invention is designated generally by the numeral 40 and also includes a power source 42 located on tracks 44. A plurality of casings 46 extend linearly from the power source into the tunnel that is being dug. Once again, the first casing 46*a* is the terminal casing. Second and subsequent casings 46*b* are positioned between the first casing and the power source, so that the casings 46 extend linearly from the power source to the cutting head 50.

Figure 4:
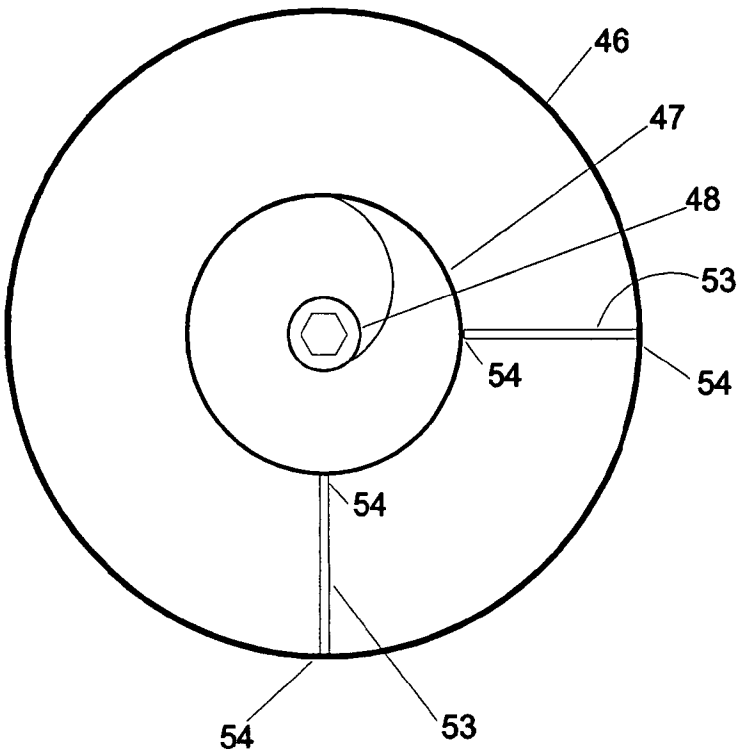
FIG. 4 is a vertical sectional view on a greatly enlarged scale of a modified embodiment to that of FIG. 3.
Figure 3:
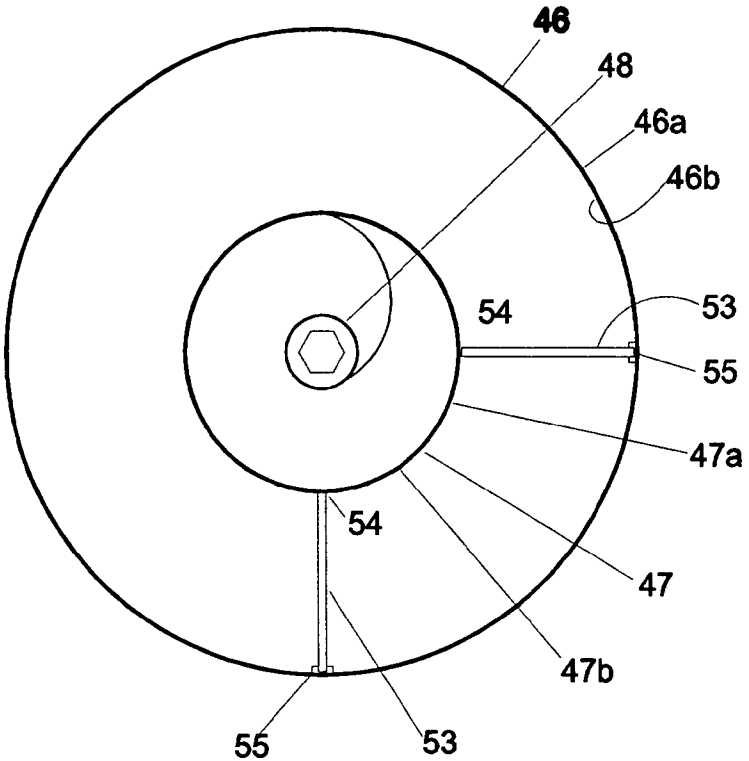
FIG. 3 is a vertical sectional view on a greatly enlarged scale of the casings and auger of the invention taken along line 3-3 of FIG. 2.
Figure 6:
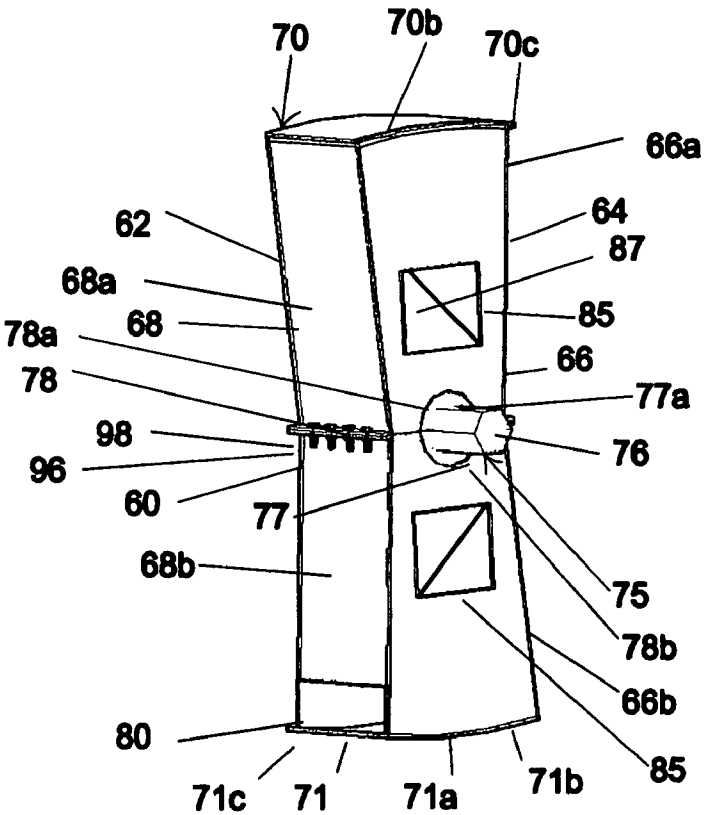
FIG. 6 is a perspective view of the spoils ejector of the invention.

Unique to this invention, a second set of casings 47 extend linearly within the first set of casings 46, with the second set of casings centered within the first set of casings. These smaller casings 47 are of a smaller diameter than the diameter of the first set of casings 46. An auger 48 with its auger blade 49 extends linearly through the smaller casings 47 with one end of the auger attached to the power source and the opposite end of the auger attached to spoils ejector 60. Spoils ejector 60 is attached to the cutting head 50 with its cutters 50*a*, stabilizers 50*b*, and dirt ports. The cutting head 50 is of the same type as in the prior art, so the cutters, stabilizers, and dirt ports are of types well known in the art. A comparison of FIGS. 3 and 4 disclose how the smaller casings 47 are maintained in their centered and linear position within the larger casings 46. In the preferred embodiment of the invention, brackets 53 have one end secured to the smaller inner casing 47 by weld 54 with the opposite end of the bracket retained in casing support groove 55. In a modified embodiment of the invention, both ends of the bracket or casing support plate 53 are welded, one to the outer surface of the inner casing 47 and the other end to the inner surface of the outer casing 46.

Figure 5:
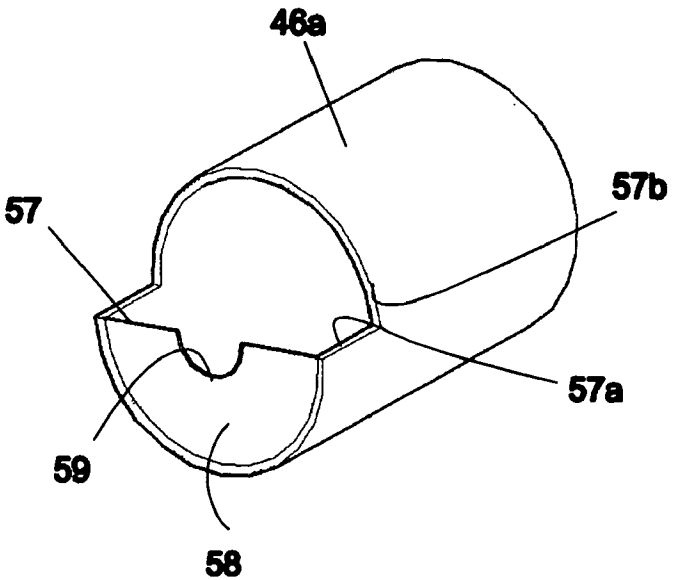
FIG. 5 is a perspective view on an enlarged scale of the terminal end of the interior casing shown in FIG. 2.
Figure 8:
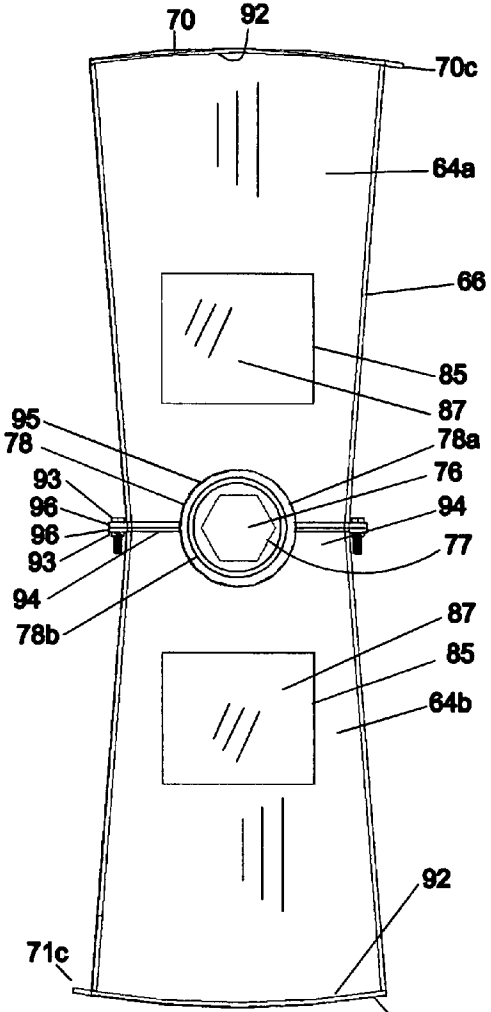
FIG. 8 is a front elevational view of the spoils ejector of FIG. 6
Figure 7:
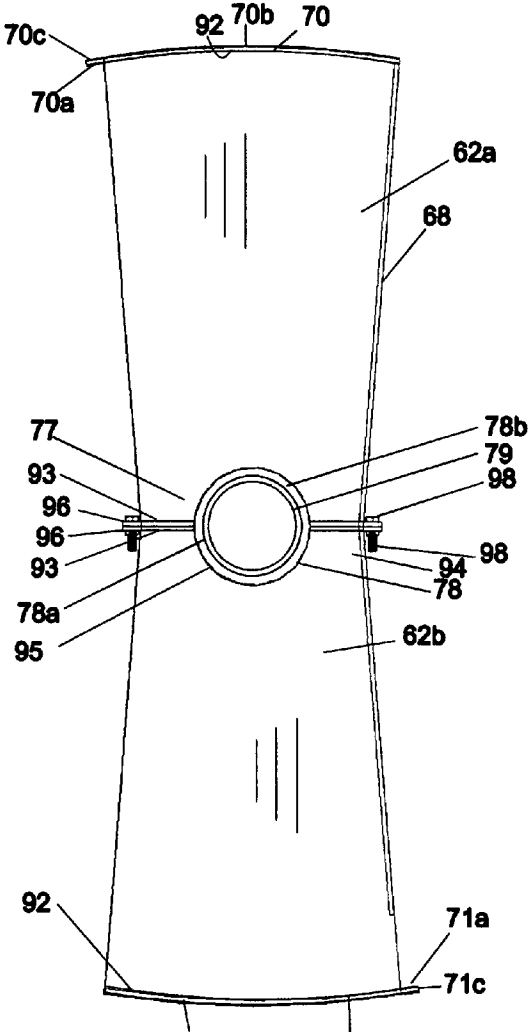
FIG. 7 is a rear elevational view of the spoils ejector of FIG. 6
Figure 10:
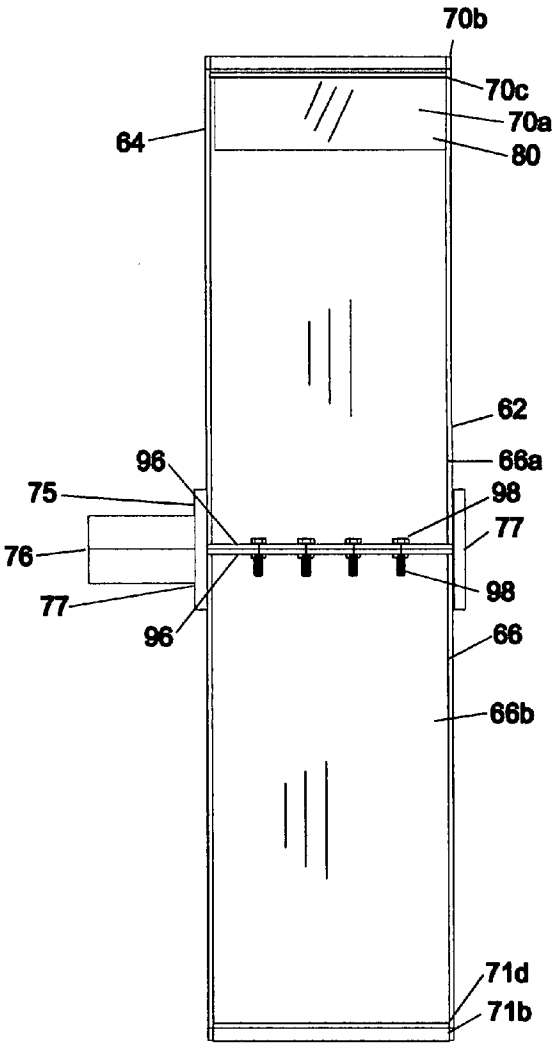
FIG. 10 is a side elevational view taken from the right side of FIG. 6
Figure 9:
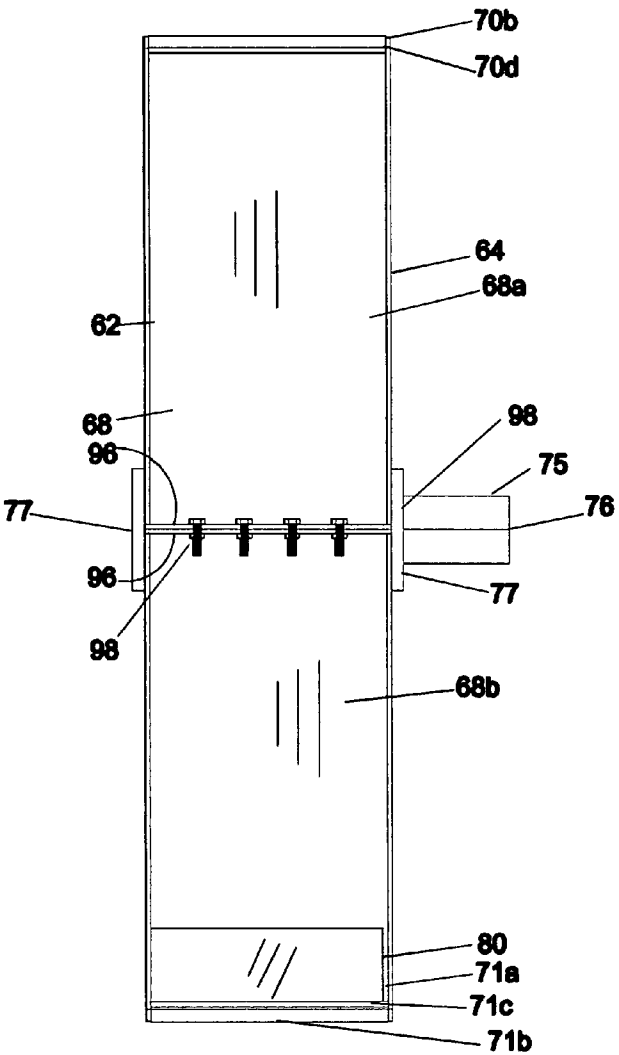
FIG. 9 is a side elevational view taken from the left side of FIG. 6

FIG. 5 discloses the terminal end of the smaller diameter casing 47 utilized in the invention. The end of the first casing 46*a* has a notched end 57 which as can be appreciated from FIG. 2 results in a gap. The notched end 57 is shown with two side surfaces 57*a* on opposite sides of the casing, and an upper arcuate surface 57*b* that extends from one side surface 57*a* to the other. An end plate 58 is secured to the terminal end of the smaller casing and has an end plate recess 59 formed at its midpoint to enable the axis of the auger to rest in the recess. The end plate covers approximately the bottom half of the area of the smaller casing.

A comparison of FIGS. 2 and 6-10 discloses the spoils ejector associated with the present invention. The spoils ejector 60 has a front 62 having a spoils ejector front first plate 62*a* and a spoils ejector front second plate 62*b*. It also has a spoils ejector back 64 having a spoils ejector back first plate 64*a* and a spoils ejector back second plate 64*b*. There is a spoils ejector first side 66 having a spoils ejector first side first plate 66*a* and a spoils ejector first side second plate 66*b*. There is also a spoils ejector second side 68 having a spoils ejector second side first plate 68*a* and a spoils ejector second side second plate 68*b*.

A first curved plate 70 has a first curved plate inner surface 70*a*, a first curved plate outer surface 70*b*, a first curved plate leading edge 70*c* which is preferably beveled, and a first curved plate rear edge 70*d*. A second curved plate 71 has a second curved plate inner surface 71*a*, a second curved plate outer surface 71*b*, a second curved plate leading edge 71*c* which is preferably beveled, and a second curved plate rear edge 71*d*. The curved plates are secured to opposite ends of the front, back and side components of the spoils ejector, with their curvature approximating that of the interior of the large casings 46 so that when the spoils ejector is attached to the auger, the two plates rotate just centrally of the terminal end large casing's interior surface.

The spoils ejector is attached to the terminal end of the auger by a male hex insert 75 located on the back of the spoils ejector. The male hex insert 75 has a hex 76 that is retained in hex hub 77. The hex hub has an outer surface 77*a* that is retained in sleeve 78, with the sleeve being formed having a first half-casing 78*a* and a second half-casing 78*b*. The sleeve extends from the spoils ejector front to the spoils ejector back. On the front of the spoils ejector, there is a hex aperture 79 that engages a hex on the cutting head 50.

The spoils ejector also includes a collector aperture 80, preferably two. One collector aperture is on the spoils ejector side between the curved plate 70 and the spoils ejector first side first plate 66*a*, with the other collector aperture being shown as located between the curved plate 71 and the spoils ejector second side second plate 78*b*. The collector aperture preferably extends from the spoils ejector front to the spoils ejector back. The beveled edge of each of the curved plates is located on a portion of the curved plate adjacent the collector aperture, the portion of the curved plate extending outwardly beyond the spoils ejector side.

In actual use, when the spoils ejector rotates within the larger casing, the rocks and/or soil that falls from the rear of the cutting head into the larger casing is scooped up into the collector aperture, falls through the interior of the spoils ejector and exits the spoils ejector at one of the spoils ports 85. The spoils ports are apertures formed in the spoils ejector back first plate and spoils ejector back second plate. The interior of the spoils ejector has an ejector plate 87 that preferably extends from the spoils ejector front wall and terminates at the portion of the spoils ejector closest to the hex hub. The ejector plate is angled to assist the spoils falling out of the spoils ejector into the gap in the inner casing where the auger blade that extends linearly inside the inner casing carries the spoils rearwardly to the area of the power source where it can be removed from the tunnel entrance area.

The spoils ejector first side and spoils ejector second side each have a first edge 92 immediately adjacent the first and second curved plates respectively. The spoils ejector first side and spoils ejector second side have respective, opposing second edges 93 where the first side and second side meet. Each respective second edge 93 has a pair of outer portions 94 and a central arcuate portion 95. The two central arcuate portions cooperate with one another to effectively encircle the hex hub 77. Additionally, along the edge of each spoils ejector side closest to the edge on the other spoils ejector side are flanges 96 which extend outwardly from the spoils ejector side edges 66 and 68. The flange on the spoils ejector side first plate cooperates with the flange on the spoils ejector side second plate through the use of fastening means 98 such as nuts and bolts to secure the two halves of the spoils ejector together.

While the form of apparatus herein described constitutes a preferred embodiment of the present invention, it is to be understood that the invention is not limited to this precise form of apparatus and that changes may be made therein without departing from the scope of the invention which is defined in the appended claims.

What is claimed is:

1. An auger boring machine having a spoils dipper, the auger boring machine comprising (a) a power source attached to an auger, (b) at least one large casing extending linearly from said power source, (c) at least one small casing located within said at least one large casing, said at least one small casing centered within said at least one large casing, said auger extending linearly within said at least one small casing, (d) a cutting head attached to a terminal end of said at least one large casing, and (e) said spoils dipper attached to said auger and to said cutting head, said spoils dipper located between a terminal end of said at least one small casing and said cutting head, said spoils dipper enclosed within said at least one large casing, said spoils dipper having a front, a back, first and second sides each attached to said front and to said back, first and second curved plates each attached to said front, said back, and to said first and second sides, at least one of said sides having a collector aperture formed therein adjacent one of said curved plates, said back having formed therein at least one spoils port.

2. The auger boring machine according to claim 1 wherein said terminal end of said at least one small casing has an end plate attached thereto, said terminal end of said at least one small casing having a notch formed therein, said notch having a pair of side surfaces and an arcuate surface, each of said side surfaces having one end connected to said arcuate surface and another end connected to said end plate.

3. The auger boring machine according to claim 2 wherein said end plate has an arcuate end plate recess formed therein.

4. The auger boring machine according to claim 1 wherein said spoils dipper front has a front first plate and a front second plate, said spoils dipper back has a back first plate and a back second plate, said spoils dipper first side has a spoils dipper first side first plate and a spoils dipper first side second plate, and said spoils dipper second side has a spoils dipper second side first plate and a spoils dipper second side second plate.

5. The auger boring machine according to claim 4 wherein said back first plate and said back second plate each have a spoils port formed therein, each spoils port forming an aperture in said back first plate and said back second plate respectively.

6. The auger boring machine according to claim 1 wherein both said first side and said second side have a collector aperture formed therein.

7. The auger boring machine according to claim 1 wherein said first curved plate and said second curved plate each have a beveled edge.

8. The auger boring machine according to claim 7 wherein each said beveled edge is located on a portion of said curved plate adjacent said collector aperture, said portion of said curved plate extending outwardly beyond said spoils dipper side.

9. The auger boring machine according to claim 1 wherein said spoils dipper is attached to said auger by a male hex insert, said male hex insert having a hex and a hex hub, said hex hub retained in a sleeve, said sleeve extending between said spoils dipper front and said spoils dipper back, said sleeve retained between said spoils dipper front first plate and said spoils dipper front second plate, and between said spoils dipper back first plate and said spoils dipper back second plate.

10. An auger boring machine having a spoils dipper comprising (a) a power source attached to an auger, at least one large casing extending linearly from said power source, said at least one large casing having a terminal end, (b) at least one small casing located linearly within said at least one large casing, said at least one small casing being centered within said at least one large casing, said auger extending linearly within said at least one small casing, said at least one small casing having a terminal end, said terminal end of said at least one small casing having an end plate attached thereto, said terminal end of said at least one small casing having a notch formed therein, said notch having a pair of side surfaces and an arcuate surface, each of said side surfaces having one end connected to said arcuate surface and another end connected to said end plate, (c) a cutting head attached to the terminal end of said at least one large casing, and (d) said spoils dipper attached to said auger and to said cutting head, said spoils dipper located between said terminal end of said at least one small casing and said cutting head, said spoils dipper enclosed within said at least one large casing, said spoils dipper having a front, a back, first and second sides each attached to said front and to said back, first and second curved plates each attached to said front, said back, and to said first and second sides, at least one of said sides having a collector aperture formed therein adjacent one of said curved plates, said back having formed therein at least one spoils port.

11. An auger boring machine spoils dipper, said spoils dipper having a back attached to an auger and a front attached to a cutting head, said spoils dipper having a front, a back, first and second sides each attached to said front and to said back, first and second curved plates each attached to said front, said back, and to said first and second sides, at least one of said sides having a collector aperture formed therein adjacent one of said curved plates, said back having formed therein at least one spoils port.

12. The spoils dipper according to claim 11 wherein said spoils dipper front has a front first plate and a front second plate, said spoils dipper back has a back first plate and a back second plate, said spoils dipper first side has a spoils dipper first side first plate and a spoils dipper first side second plate, and said spoils dipper second side has a spoils dipper second side first plate and a spoils dipper second side second plate.

13. The spoils dipper according to claim 12 wherein said back first plate and said back second plate each have a spoils port formed therein, each spoils port forming an aperture in said back first plate and said back second plate respectively.

14. The spoils dipper according to claim 12 wherein said both said first side and said second side have a collector aperture formed therein.

15. The spoils dipper according to claim 12 wherein said spoils dipper has a male hex insert, said male hex insert having a hex and a hex hub, said hex hub retained in a sleeve, said sleeve extending between said spoils dipper front and said spoils dipper back, said sleeve retained between said spoils dipper front first plate and said spoils dipper front second plate, and between said spoils dipper back first plate and said spoils dipper back second plate.

* * * * *